United States Patent [19]

Nielsen

[11] 4,445,437

[45] May 1, 1984

[54] RAILWAY TRACK TAMPING MACHINE

[75] Inventor: Arne Nielsen, La Conversion, Switzerland

[73] Assignee: Sig Societe Industrielle Suisse, Schaffhausen, Switzerland

[21] Appl. No.: 186,908

[22] Filed: Sep. 15, 1980

[30] Foreign Application Priority Data

Oct. 5, 1979 [CH] Switzerland ..... 8998/79

[51] Int. Cl.[3] ..... E01B 27/16; E01B 31/00; E02F 5/22

[52] U.S. Cl. ..... 104/12; 37/104; 254/43

[58] Field of Search ..... 37/104, 105; 104/12; 171/16; 254/43, 45

[56] References Cited

U.S. PATENT DOCUMENTS

| | | | |
|---|---|---|---|
| Re. 23,687 | 7/1953 | Hursh et al. | 104/12 |
| 1,351,246 | 8/1920 | Hastings | 104/12 |
| 2,587,324 | 2/1952 | Hursh et al. | 104/12 |
| 3,653,327 | 4/1972 | Sautered | 104/12 |

FOREIGN PATENT DOCUMENTS

| | | | |
|---|---|---|---|
| 507415 | 6/1971 | Switzerland | 104/12 |

*Primary Examiner*—Bruce H. Stoner, Jr.
*Assistant Examiner*—Howard Beltran
*Attorney, Agent, or Firm*—Hedman, Casella, Gibson, Costigan and Hoare

[57] ABSTRACT

A tamping machine intended for tamping on the open track and below switches and cross overs. It is equipped with independent tamping units arranged on opposite sides of each line of rail and each connected to the chassis by a mechanism comprising: a transverse slideway actuated by a first piston-cylinder unit; a slide block mounted on the slideway and on which the tamping unit is articulated; an arm fastened to the tamping unit; and a connecting rod connecting said arm to the chassis. The slide block of the outer unit is fastened on the slideway while the slide block of the inner unit is movable on said slideway and driven by a second piston-cylinder unit. Thus, the transverse trajectory of the tamping tools is sufficiently flat to avoid a correction of their depth of penetration upon the tamping of long ties.

6 Claims, 4 Drawing Figures

9
18
16
15
21
8
1
12
17
17'
10
10'
22
23
24
15'
18'
7
6
II
II
34
4
33
32
31
28
29
30

RAILWAY TRACK TAMPING MACHINE

The object of the present invention is a railway track tamping machine intended for tamping the ballast below the ties both on open track and in regions occupied by track apparatus such as switches and crossings.

In these particular regions, the tamping tools must not only be movable vertically in order to permit their insertion into the ballast on both sides of each line of rail, which is sufficient on the open track, but also mobile transversely in order to be able to be moved away from the obstacle consisting, for instance, of a guard rail or a switch.

There already exist tamping machines in which the tamping tools are provided with the ability of transverse displacement and which are mounted for this purpose, on independent tamping units arranged on opposite sides of each line of rail and movable transversely.

Thus on a tamping machine described in U.S. Pat. No. 2,587,324, the two tamping units arranged above each line of rail are mounted movable in translation in fixed transverse slideways in order to permit tamping by displacement of the tools with different operating strokes on the two sides of the line of rail.

On another known tamping machine, especially designed for the tamping of switches and crossings, described in Swiss Patent No. 507,415, the two tamping units arranged above each line of rail are articulated at their upper part to a fixed support on the frame of the machine so that their transverse mobility is obtained by pivoting in a vertical plane.

These two types of transverse mobility of the tamping tools, namely by translation and by pivoting, each has its advantages and its disadvantages.

The mobility by translation obtained on the tamping machine described in the first-mentioned patent makes it possible accurately to tamp to the same depth with respect to the tie over the entire transverse stroke of the tamping tools, this stroke being linear and parallel to the said tie. However, this stroke, which would be sufficient to permit tamping around a switch, a guard rail or a frog is necessarily small due to the transverse space taken up by the slidebars, particularly towards the outside of the track where they cannot exceed the limits of the gauge authorized in non-operating configuration for travel to the work site. Therefore, with the tools mounted in this way, it would not be possible to tamp over a sufficient length ties longer than the normal length which extend, in a zone occupied by a switch, below the rails of the track, rejoining the track on which the tamping machine moves. This is a drawback since the insufficient tamping of these ties unbalances the seat of the switch.

In the tamping machine described in the second patent mentioned, the transverse mobility of the tamping tools, obtained by pivoting the units which bear them, makes it possible to avoid this drawback since these tools can thus be moved far beyond the lines vertical to the articulation of the said units and therefore beyond the gauge within which this articulation must be contained. However, the transverse stroke of the tools mounted in this fashion is a circular arc whose center consists of the articulation of the tamping unit and the radius of which consists of the distance separating said articulation from the tools. This has the result that, while moving away from the vertical line of this articulation, the tools rise with respect to the tie by an amount which is much larger the greater the distance apart. In order to avoid irregular tamping as a result of this lifting, the tamper must normally, on this type of tamping machine, each time correct the vertical stroke of the tools as a function of their distance apart, by acting on adjustable stroke limit stops. This necessity results, in the design of the machine, in a substantial increase in the vertical stroke of the tools in downward direction which is superfluous for tamping on the open track. Furthermore, this correction, which is difficult and a delicate matter, is most of the time neglected by the operator who is already greatly absorbed by the movements of avoiding obstacles from the switches and crossings and who, subjected to demands for ever-increasing output, no longer takes the time.

By another type of transverse mobility of the tamping tools, in which movements of translation and of pivoting are positively combined, the tamping machine in accordance with the invention provides a solution which makes it possible to avoid the above-mentioned drawbacks which are inherent in each of them. This combination in fact makes it possible at the same time to make the rising of the tools during their movement apart negligible, to avoid the necessity of the operator correcting their vertical stroke, and to increase this distance apart in operation without encroaching beyond the railway gauge in non-operating configuration.

The accompanying drawing shows by way of example, one embodiment of the object of the invention, as well as a variant construction.

Figure 1:
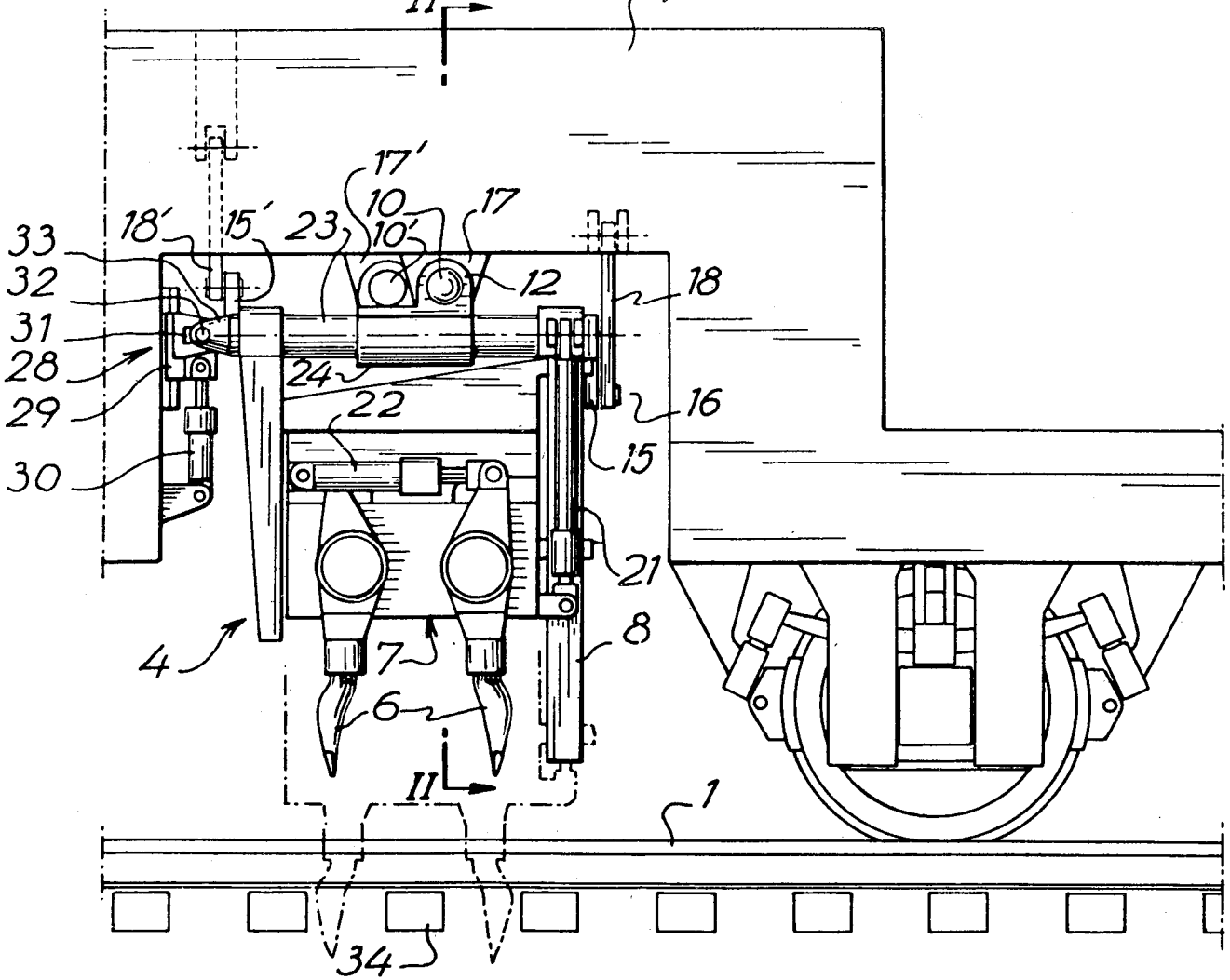
FIG. 1 is a view in partial elevation of the embodiment given by way of example, showing its particular camping arrangement.
Figure 2:
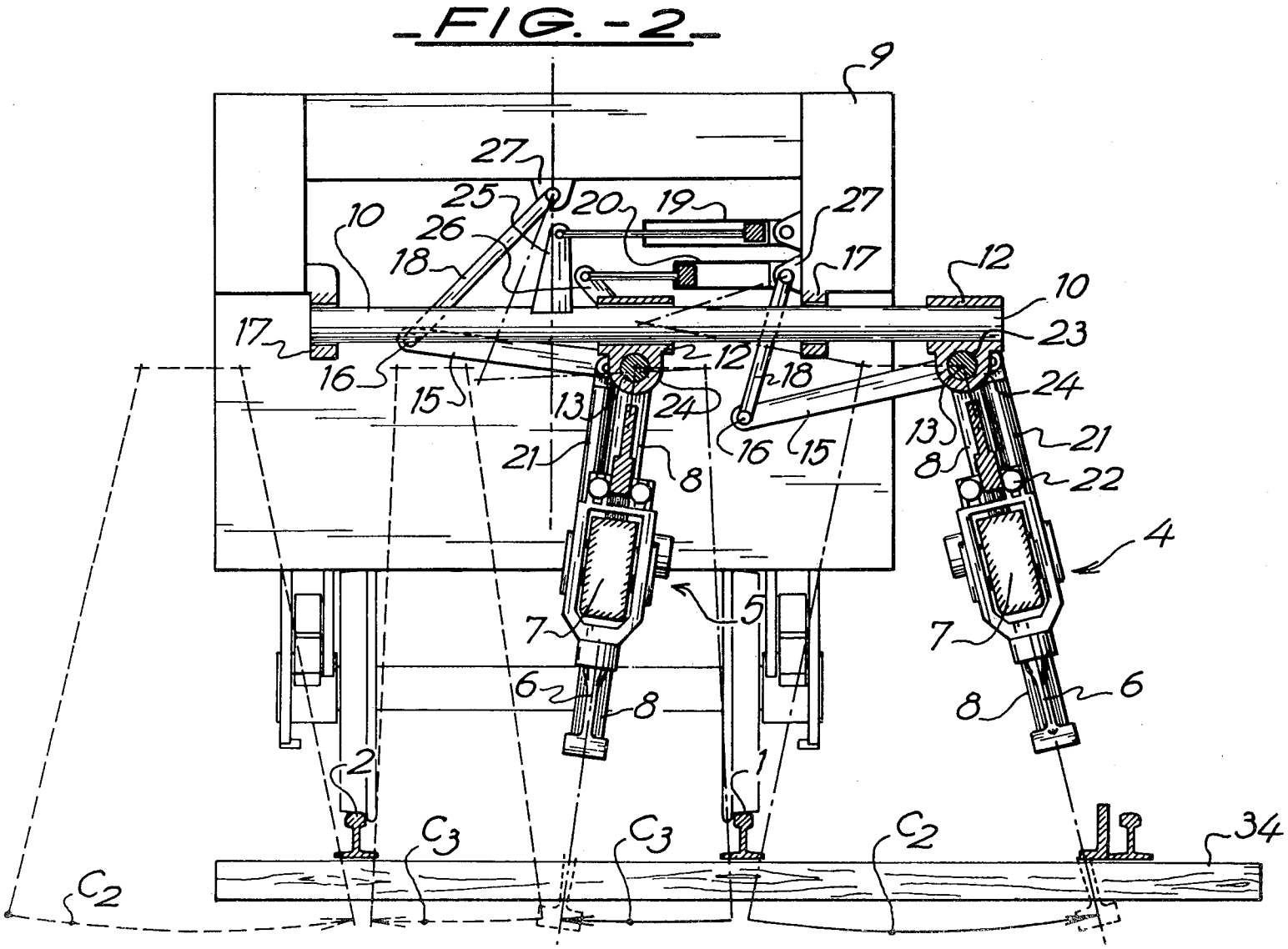
FIG. 2 is a partial section through FIG. 1 along the section line II—II.

The tamping device shown in FIGS. 1 and 2 comprises two independent tamping units 4 and 5 arranged above and on opposite sides of each of the two lines of rail 1 and 2 of the track. For the sake of greater clarity only the two tamping units of one line of rail 1 have been shown, those of the other line being identical.

Each of these two tamping units 4 and 5 has two conventional pivoting tools 6, which tools may be shown in U.S. Pat. No. 3,653,327 issued Apr. 4, 1972. These tools are mounted in opposition on a tool holder 7 which is movable vertically by sliding in a gantry 8 which is itself mounted movably in a vertical plane transverse to the track on the rolling frame 9 of the tamping machine by means of a connecting device which will be described hereinafter. The plunging of the tools 6 into the ballast is obtained in conventional manner, for instance as shown in U.S. Pat. No. 3,653,327, by the action of a cylinder-piston unit 21. The latter is arranged between the tool holder 7 and the gantry 8 and the opening and closing of the tools 6 is obtained by a cylinder-piston unit 22 arranged between each of them and the tool holder 7.

The connecting device which connects each gantry 8 to the frame 9 of the tamping machine comprises:

A transverse linear slideway 10 of circular cross-section mounted slideably in two spaced bearings 17, each fastened to one of the two lateral lengthwise members of the frame 9.

A slide block 12 mounted on the slideway 10 and having a first articulation 13 on which the upper part of the gantry 8 is pivotally mounted in a vertical plane parallel to the axis of the slideway 10, said articulation being formed by the turning assembly of the cross member 23 connecting the two uprights of the gantry 8 in a bearing 24 which is rigidly connected with the said slide block 12.

An arm 15 rigidly connected to the upper part of the gantry 8 and having, at its end, a second articulation 16 spaced from the first articulation 13 in the direction transverse to the track.

A connecting rod 18 for movement coordination articulated at its ends on the one hand to a bracket 27 fastened to the frame 9 of the tamping machine and on the other hand to the second articulation 16 borne by the arm 15 to cause the pivoting of the gantry around articulation 13 when slideway 10 is moved into translation.

The axes of the two articulations 13 and 16 and that of the articulation of the connecting rod 18 on the bracket 27 are parallel to each other and perpendicular to the vertical plane transverse to the track which contains the axis of the slideway 10.

The slideway 10 has a lug 25 fastened between the two bearings 17 and is moved in translation by a first piston-cylinder unit 19 interposed between the chassis 9 and the said lug, and the slide block 12 of the tamping unit 4 arranged to the outside of the line of track 1 is fastened rigidly at the end of the said slideway 10.

The slide block 12 of the tamping unit 5 arranged towards the inside of the line of rail 1 is, on the other hand, mounted slideably on the slideway 10. It has a lug 26 and is moved in translation by a second piston-cylinder unit 20 interposed between the chassis 9 and the said lug.

In order to assure the freedom of movement of the arm 15/rod 18 assembly of each tamping unit, said assembly is arranged, in the case of each of them, on the opposite side with respect to the tamping unit preceding it in the direction transverse to the track. Thus in FIG. 1 this assembly 15–18 is located to the right in the case of the first tamping unit 4, while in the case of the second unit 5, which is located towards the rear and is not visible, this assembly is shown in thin lines on the left with the reference numbers 15' and 18'.

Opposite this arm 15/rod 18 assembly there is arranged, at the end of the cross member 23 of each gantry 8, a mechanism 28 for immobilizing and adjusting the angular position of the said gantry around the slideway 10 in a plane parallel to the longitudinal axis of the track. This mechanism, which is useful in the case of tamping oblique ties, is formed of a carriage 29 which is moved vertically by a piston-cylinder unit 30 and has a horizontal slideway 31 in which there is engaged an arm 32 fastened at right angles to a trunnion 33 concentric to the cross member 23 of the gantry 8. For greater clarity, the mechanism for the immobilizing of the gantry of the inner tamping unit 5, which is identical, has not been shown.

Figure 3:
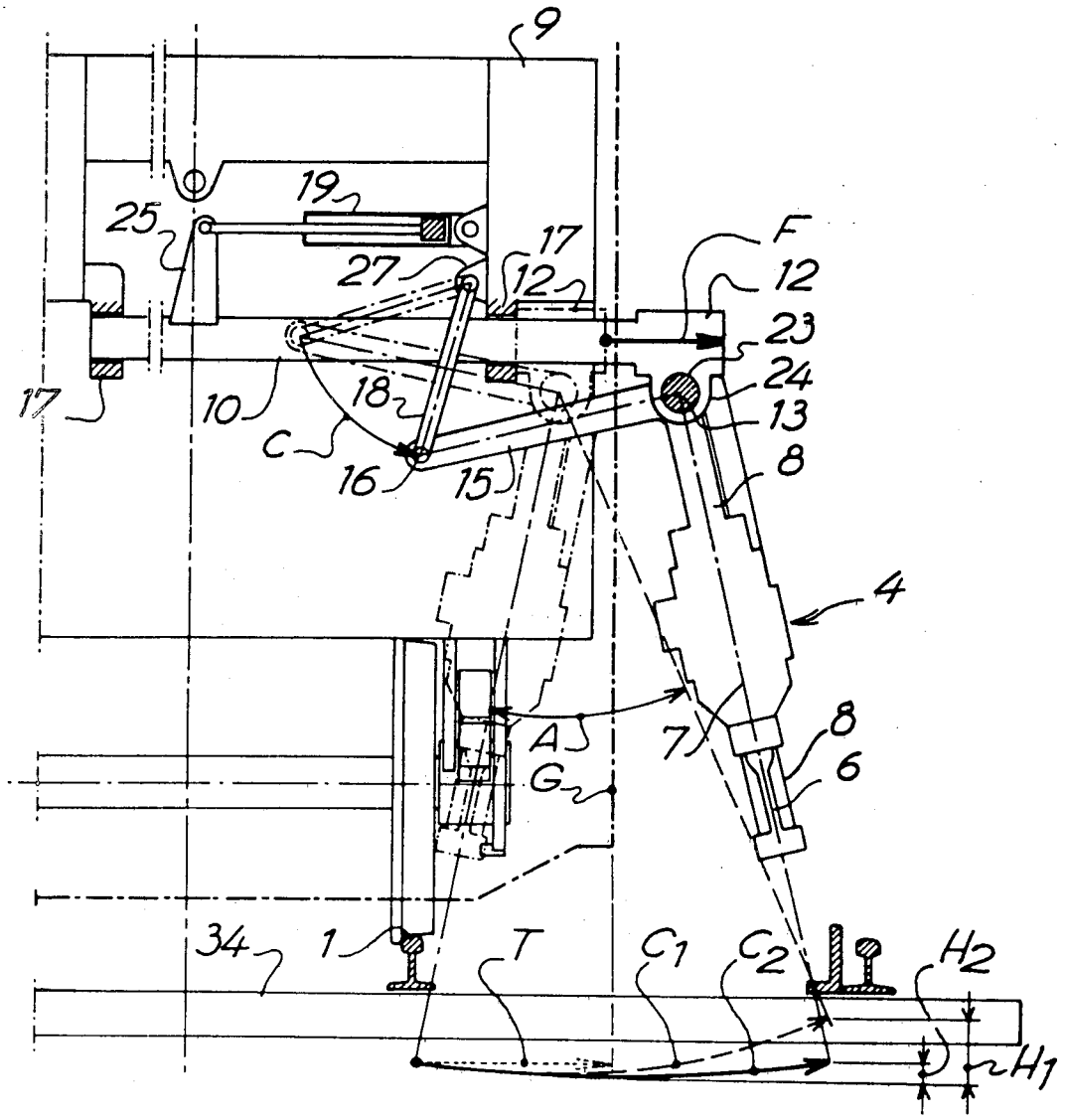
FIG. 3 is an explanatory diagram.

Developed in this manner, the tamping device makes it possible to move the tools of the tamping units 4 and 5 away from each line of rail by the positive combination of a translation and pivoting of their gantries 8 in a vertical plane transverse to the railway track. This combination of movements is illustrated in FIG. 3, in which the two extreme positions of the outer tamping unit 4 are shown, one in thin dot-dash lines and the other in solid lines. By the action of the piston-cylinder unit 19 on the slideway 10, the slide block 12 fastened at the end of said slideway is displaced from its withdrawn position shown in dot-dash lines to its extended position shown in solid lines, as indicated by the arrow F. During this translation, the end 16 of the arm 15 fastened to the gantry 8 necessarily describes a circular arc C of a radius constituted by the connecting rod 18 connecting it to the chassis 9 of the tamping machine, thus imparting to the gantry 8 a movement of pivoting combined with a movement of translation of its articulation 13 borne by the slide block 12.

The total trajectory of the tamping tools 6 which results from this combination of movements when these tools are in working position below a switch tie 34 assumes a relatively flat curved course $C_2$ of dip $H_2$ representative of the extreme differences in vertical position with respect to the said tie 34.

In order to illustrate the advantages of the invention over the prior art set forth at the beginning hereof, the possible trajectories of maximum amplitude of the tools of the two types of tamping machines mentioned, indicated as T and $C_1$ respectively, are shown in this FIG. 3, as well as the railway gauge G.

The linear path T represents the maximum displacement which could be obtained with a tamping device similar to that described in the first-mentioned U.S. Pat. No. 2,587,324. This displacement by translation cannot in fact exceed the limit of the gauge G due to the transverse space taken up by the guide slide members of the tamping units, which cannot be retracted. Therefore it is not possible with a tamping machine of this type to tamp a long tie such as the tie 34.

The circular-arc trajectory $C_1$ represents the maximum transverse displacement which can be obtained with a tamping device similar to the one described in the second-mentioned Swiss Patent No. 507,415. This displacement by a simple pivoting of angular amplitude A of the tamping unit would permit sufficient tamping of the tie 34 but it is seen that the difference in vertical position $H_1$ of the tools with respect to the said tie requires, during the course of displacement, corrections in the vertical position of the tools 6, this trajectory $C_1$ having an excessive difference in level and coming against the tie 34 at the end of the stroke.

By way of comparison, the trajectory $C_2$ obtained by the combination of movements in accordance with the invention is sufficiently long and flat to avoid the necessity of such corrections in order to assure sufficient tamping of a long switch tie such as the tie 34 and do so without going beyond the railway gauge G in retracted non-operating position, indicated here by thin dot-dash lines.

The trajectory $C_3$ (FIG. 2) of the tools of the inner tamping unit 5 which is obtained by the same combination of movements but in which the amplitude of the translation is greater than that of the pivoting is even flatter than the trajectory $C_2$. It is therefore possible to balance as desired, in accordance with the requirements, which may be different from one network or one country to the other, the amplitude of the transverse displacement of the tamping tools and the maximum amplitude of their vertical differences in position within the limits of the clearance and of the possible strokes of the movable elements of the connecting device of each tamping unit within the railway gauge G.

Figure 4:
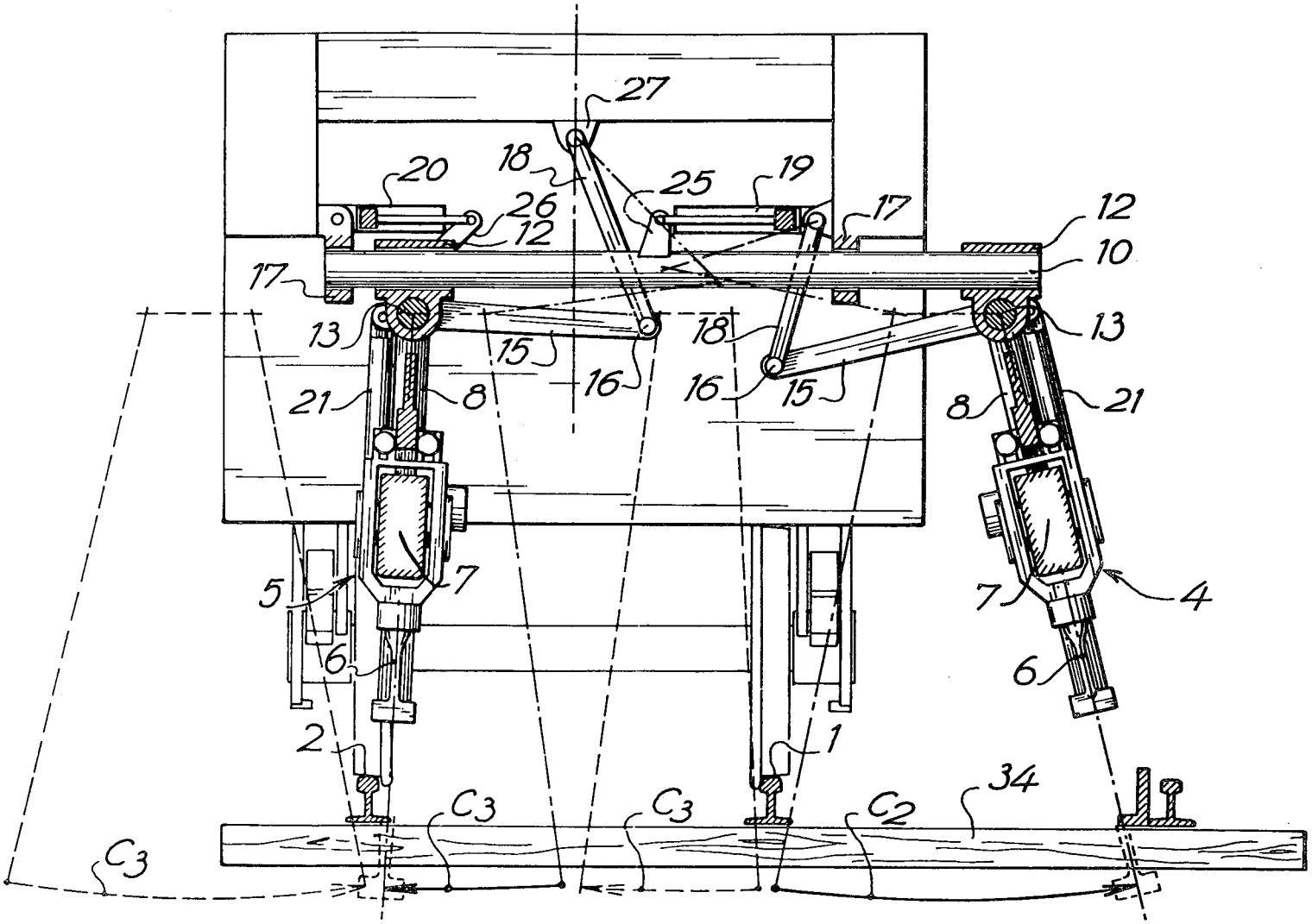
FIG. 4 is a partial elevation of the variant.

These trajectories $C_2$ and $C_3$ of the tamping tools have been also represented for the four tamping units in FIG. 2, as well as in FIG. 4 of the variant, in order to show the size of the total possible tamping stroke as compared with the width of the track indicated by the distance apart of the rails 1 and 2.

The tamping units 4 and 5 of the other line of rail 2, which are not shown in FIGS. 1 and 2, are arranged above said line in the same manner as those shown above the line of rails 1, but on a slideway 10 and with bearings 17 shifted with respect to the corresponding elements, as indicated in fine lines in FIG. 1, marked 10' and 17'.

In the variant shown in FIG. 4, it is no longer the two tamping units of the same line of rail 1 which are mounted on a common slideway 10 but the tamping unit 4 outside one line of rail 1 and the tamping unit 5 inside the other line of rail 2. This particular mounting makes it possible, if necessary, to increase the transverse stroke of the slide block 12 of the gantry of the inner tamping unit 5 on the slideway 10. In this variant, all the component parts of the connecting device of the inner unit 5 shown in FIG. 2 are present again, but arranged symmetrically with respect to the axis of the gantry 8. Except for this difference, the operation and its effects are the same as those already described and shown in FIG. 2.

Other variants, not illustrated, can also be made in the embodiment of the tamping device of the tamping machine of the invention.

Thus each tamping unit can be mounted on its own slideway 10 instead of a common slideway for both tamping units, and in this case the slide block 12 is either fixed to the end of the said slideway 10 when the latter is mounted movable in translation or is mounted slideable on a fixed slideway 10, which latter case can be applied in particular for an inner tamping unit 5.

The slide block 12 can also be moved in translation otherwise than by action on it or on the slideway 10, as in the structures described, for instance by action on the arm 15 or on the connecting rod 18.

The locking and adjusting mechanism 28 for the angular position of the gantry 8, which is useful in the case of the tamping of oblique ties, can be replaced by any other means permitting the same function. For example, it is possible to mount two slide blocks 10 spaced apart on the cross member 23 of each gantry and to engage them on two slideways 10 in such a manner as to angularly immobilize the gantry 8 in its vertical plane parallel to the track, and to mount these two slideways 10 no longer in fixed bearings 17 but in bearings which are rigidly connected with a plate turning in a horizontal plane and articulated below the chassis 9 of the tamping machine.

Finally, the positive combination of the movements of translation and pivoting of the gantries 8 can be obtained by means equivalent to those described. For example, the connecting rod 18 for the coordination of these two movements can be replaced by a cam in the form of a slot developed in a plate fastened to the chassis 9, in which there is engaged a roller fastened to the arm 15 or to a part similar to the latter which is connected to the gantry 8. Likewise, one could contemplate obtaining these two movements by two separate drive members, one driving the slide block 12 in translation in the manner of the piston-cylinder unit 19 or the piston-cylinder unit 20 and the other effecting the pivoting of the gantry 8 by resting against the slide block 12, and coordinating their actions by an energy distributor, for instance by a pressure fluid-flow distribution valve, in the event that the driving means are piston-cylinder units.

This last-meniontied variant can advantageously be employed, for instance, in the event of lack of space for the movement of the arm 15 and rod 18.

What is claimed is:

1. In a railway track tamping machine comprising a rolling chassis for rolling on a railway track, said rolling chassis being equipped with two independent tamping units arranged on opposite sides of each line of rails of said railway track, each of said tamping units comprising at least two pivoted tamping tools mounted in opposition on a tool holder which is mounted for vertical movement in a gantry which is, in turn, mounted movably on the rolling chassis in a vertical plane transverse to the railway track, the improvement of each gantry being mounted on the rolling chassis via a connecting device comprising means for effecting translation movement of the gantry transverse to the track, means for effecting pivotal movement of the gantry transverse to the track, coordinating means to combine said translation movement and said pivotal movement of the gantry transverse to the track, and motor means for driving one of said means for effecting translation movement, said means for effecting pivotal movement, and said coordinating means.

2. A tamping machine according to claim 1, wherein said connecting device is formed of a transverse slideway arranged above said gantry and mounted for sliding in two spaced bearings fastened to the rolling chassis, a slide block mounted on said slideway and having a first articulation on which the upper part of the gantry is pivotally mounted, an arm rigidly connected to said upper part of the gantry and having a second articulation spaced from said first articulation in the transverse direction of the track, a connecting rod articulated on the one hand to a bracket fastened to the chassis and on the other hand to said second articulation, and a motor for driving in translation said slideway.

3. A tamping machine according to claim 1, wherein said connecting device is formed of a transverse slideway arranged above said gantry and mounted for sliding in two spaced bearings fastened to the rolling chassis, a slide block mounted on said slideway and having a first articulation on which the upper part of the gantry is pivotally mounted, an arm rigidly connected to said upper part of the gantry and having a second articulation spaced from said first articulation in the transverse direction of the track, a connecting rod articulated on the one hand to a bracket fastened to the chassis, and on the other hand to said second articulation and a motor for driving in translation said slide block.

4. A tamping machine according to claim 1, wherein said connecting device is formed of a transverse slideway arranged above said gantry and mounted for sliding in two spaced bearings fastened to the rolling chassis, a slide block mounted on said slideway and having a first articulation on which the upper part of the gantry is pivotally mounted, an arm rigidly connected to said upper part of the gantry and having a second articulation spaced from said first articulation in the transverse direction of the track, a connecting rod articulated on the one hand to a bracket fastened to the chassis and on the other hand to said second articulation, and a motor for driving in translation said slideway and slide block.

5. A tamping machine according to claim 1, wherein said connecting device is formed of a transverse slideway arranged above said gantry and mounted for sliding in two spaced bearings fastened to the rolling chassis, a slide block mounted on said slideway and having a first articulation on which the upper part of the gantry is pivotally mounted, an arm rigidly connected to said upper part of the gantry and having a second articulation spaced from said first articulation in the transverse direction of the track, and a connecting rod articulated on the one hand to a bracket fastened to the chassis and on the other hand to said second articulation, and wherein the two slide blocks of the gantries of the two tamping units arranged on opposite sides of the same line of rails are mounted on a common slideway moved in translation by a first motor, while the slide block of the gantry of the tamping unit to the outside of said line of rails is rigidly fastened to the end of said common slideway and the slide block of the gantry of the tamping unit to the inside of said line of rails is mounted slidably on said slideway and moved in translation by a second motor.

6. A tamping machine according to claim 1, wherein said connecting device if formed of a transverse slideway arranged above said gantry and mounted for sliding in two spaced bearings fastened to the rolling chassis, a slide block mounted on said slideway and having a first articulation on which the upper part of the gantry is pivotally mounted, an arm rigidly connected to said upper part of the gantry and having a second articulation spaced from said first articulation in the transverse direction of the track, and a connecting rod articulated on the one hand to a bracket fastened to the chassis and on the other hand to said second articulation, and wherein the slide block of the gantry of a tamping unit arranged to the outside of one line of rails and the slide block of the gantry of the tamping unit arranged to the inside of the other line of rails are mounted on a common slideway moved in translation by a first motor, and the slide block of the gantry on the outside of said one line of rails is fastened rigidly to the end of said common slideway while the slide block of the gantry on the inside of said other line of rails is mounted slidably on said common slideway and moved in translation by a second motor.

* * * * *